US007992231B1

(12) United States Patent
Schlicksup

(10) Patent No.: US 7,992,231 B1
(45) Date of Patent: Aug. 9, 2011

(54) URINAL

(76) Inventor: Daniel J. Schlicksup, Dunlap, IL (US)

( * ) Notice: Subject to any disclaimer, the term of this patent is extended or adjusted under 35 U.S.C. 154(b) by 60 days.

(21) Appl. No.: 12/589,188

(22) Filed: Oct. 19, 2009

Related U.S. Application Data

(60) Provisional application No. 61/197,257, filed on Oct. 24, 2008.

(51) Int. Cl.
*E03D 9/00* (2006.01)
*E03D 13/00* (2006.01)

(52) U.S. Cl. ..... 4/300.3; 4/310

(58) Field of Classification Search ..... 3/300.3, 3/301, 310, 311; D23/302
See application file for complete search history.

(56) References Cited

U.S. PATENT DOCUMENTS

| | | | | | |
|---|---|---|---|---|---|
| 945,837 | A * | 1/1910 | Baker | ..... | 4/306 |
| 1,114,670 | A | 10/1914 | Baker | | |
| 1,379,206 | A | 5/1921 | Ohara | | |
| 5,027,448 | A | 7/1991 | Wilkins | ..... | 4/310 |
| 5,255,397 | A | 10/1993 | Poole | ..... | 4/310 |
| 5,287,563 | A | 2/1994 | Peters | ..... | 4/310 |
| D354,122 | S * | 1/1995 | Carlier | ..... | D23/302 |
| 6,470,504 | B1 | 10/2002 | Neuo | ..... | 4/310 |

* cited by examiner

*Primary Examiner* — Gregory Huson
*Assistant Examiner* — Janie Christiansen
(74) *Attorney, Agent, or Firm* — Philip L. Bateman

(57) ABSTRACT

A splash-eliminating urinal contains an outer body and a receptor cavity within the outer body. The receptor cavity contains a rear surface having projecting concave rear walls that converge to form sides of an outwardly-projecting vertical ridge, and two side walls that transition to the rear walls. When a stream of urine is directed onto the rear walls, it adheres by surface tension without causing a splash.

9 Claims, 5 Drawing Sheets

URINAL

CROSS-REFERENCE TO RELATED APPLICATION

This application claims the benefit of U.S. Provisional Application Ser. No. 61/197,257, Oct. 24, 2008.

FIELD OF THE INVENTION

This invention relates to baths, closets, sinks, and other plumbing fixtures. More particularly, this invention relates to urinals.

BACKGROUND OF THE INVENTION

A urinal is a receptacle used by men for urinating. Urinals are common fixtures in public washrooms. A urinal is typically made of ceramic or metal with a water rinse (commonly known as a flush) and a bottom drain. Urinals are either of the individual type or the trough type suitable for simultaneous use by several men. Individual urinals are either floor mounted or elevated a short distance off the floor. Trough urinals are generally elevated a short distance off the floor.

When a man uses a urinal, the stream of urine has a tendency to splash off the back wall and/or the bottom. The splashed urine can land on the floor and/or other surfaces around the urinal, and can even land on the user himself.

Urinals have been disclosed to contain the splash from reaching adjacent surfaces and/or user. These urinals attempt to control the splash by being lower, deeper, narrower, wider, or by including splash shields. For example, Baker, U.S. Pat. No. 1,114,670, Oct. 20, 1914, discloses a urinal with a vertical chamber in the back wall. Splash is contained in the Baker urinal only if the user directs his stream precisely into the chamber. Ohara, U.S. Pat. No. 1,379,206, May 24, 1921, discloses a urinal with a series of vertical rods along the back wall. The Ohara urinal is difficult to clean. Wilkins, U.S. Pat. No. 5,027,448, Jul. 2, 1991, discloses a urinal with offset and converging side walls to direct the splash inwardly. The Wilkins urinal is exceptionally deep.

Poole, U.S. Pat. No. 5,255,397, Oct. 26, 1993, discloses a urinal with side walls that converge to form a vertical trough. The Poole urinal is exceptionally deep. Peters, U.S. Pat. No. 5,287,563, Feb. 22, 1994, discloses a urinal with a receptor cavity, two deflectors, and two shields. The shields of the Peters urinal are prone to breakage and the urinal is expensive to manufacture. Neuo, U.S. Pat. No. 6,470,504, Oct. 29, 2002, discloses a urinal with concave converging side walls and a downwardly curved back wall. Urine directed against either the side walls or back wall is deflected inwardly and downwardly. The Neuo urinal is exceptionally deep.

As a group, these prior art urinals are difficult to clean and prohibitively expensive to manufacture and install. They are also significantly different in appearance than conventional urinals and, therefore, are undesirable because they lack familiarity. They are also different in size and shape from conventional urinals so they cannot easily be used as replacements. None of the prior art urinals attempts to address the splash problem by eliminating the splash.

Accordingly, there is a demand for a urinal that eliminates, rather than simply redirects, splash. There is also a demand for such a urinal that has the same general appearance as a conventional urinal. There is further a demand for such a urinal that is the same depth, is as sturdy, uses the same plumbing connections, and can be manufactured as cheaply as conventional urinals.

SUMMARY OF THE INVENTION

The general object of this invention is to provide an improved urinal. A more particular object is to provide a urinal that eliminates, rather than simply redirects, splash. Another object is to provide a urinal that eliminates splash and that otherwise has the same general appearance as a conventional urinal. Another object is to provide a splash-eliminating urinal that is the same depth, is as sturdy, uses the same flushing and drainage plumbing connections, and can be manufactured as cheaply as conventional urinals.

I have invented a splash-eliminating urinal. The urinal comprises: (a) an outer body comprising a rear wall having a top and a bottom, a top surface projecting outwardly from the top of the rear wall, a bottom surface projecting outwardly from the bottom of the rear wall, and two side walls projecting outwardly and extending between the top surface and the bottom surface; and (b) a receptor cavity within the outer body, the cavity comprising an upper surface, a lower surface having a drain, a rear surface having projecting concave rear walls that converge to form sides of an outwardly-projecting vertical ridge, and two side walls that transition to the rear walls. When a stream of urine is directed to onto the rear walls, it adheres by surface tension without causing a splash.

The urinal of this invention eliminates, rather than simply redirects, splash. It is the same depth, is as sturdy, uses the same flushing and drainage plumbing connections, and can be manufactured as cheaply as conventional urinals.

DETAILED DESCRIPTION OF THE INVENTION

Figure 1:
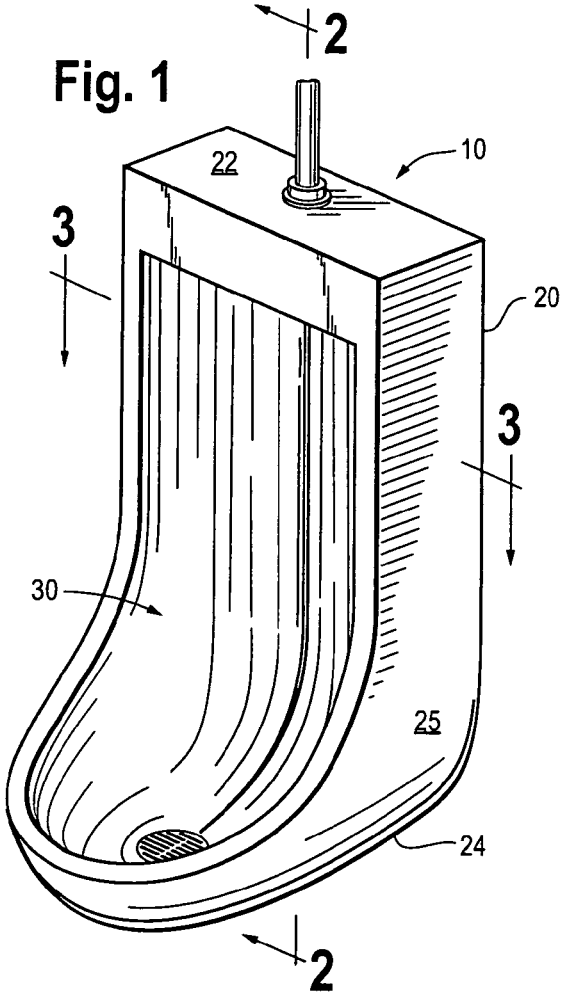
FIG. 1 is a perspective view of a first embodiment of the urinal of this invention.
Figure 2:
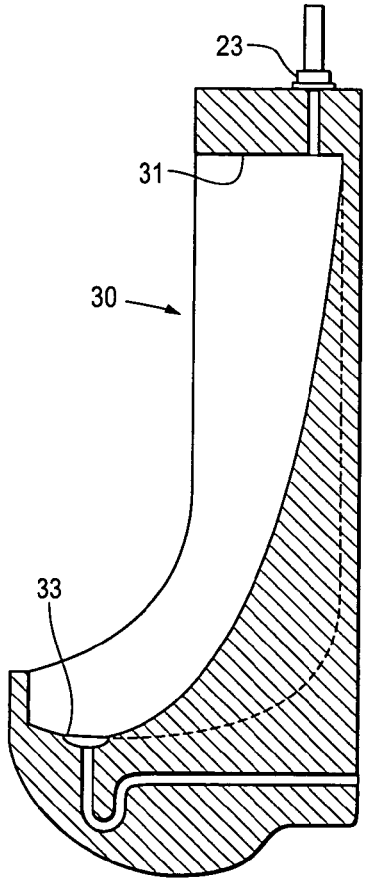
FIG. 2 is a sectional view thereof taken along line 2-2 of FIG. 1.
Figure 3:
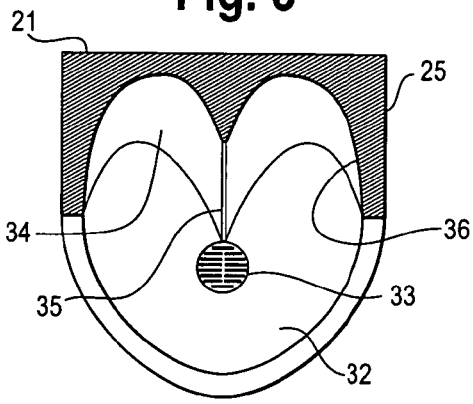
FIG. 3 is a sectional view thereof taken along line 3-3 of FIG. 1.
Figure 4:
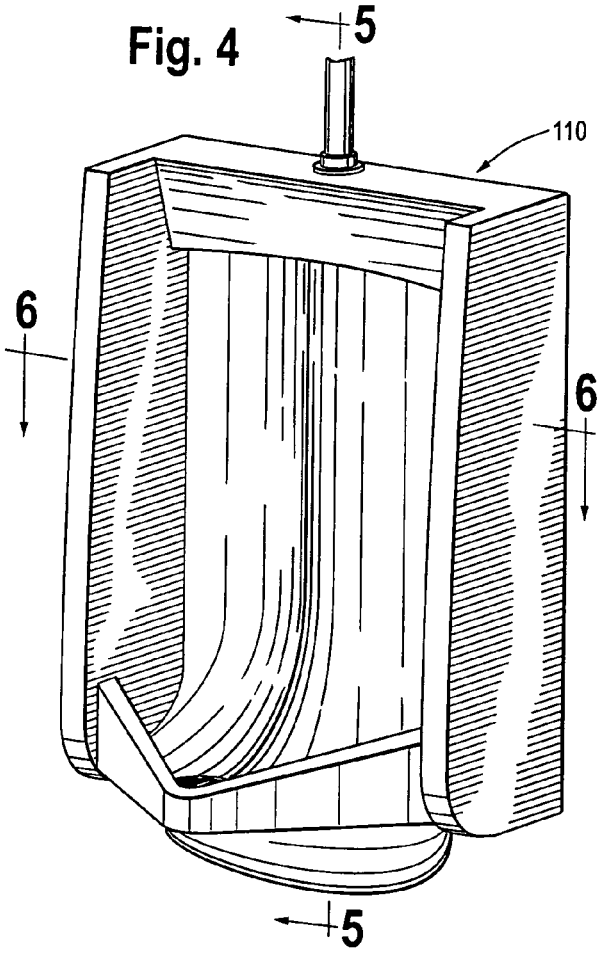
FIG. 4 is a perspective view of a second embodiment of the urinal of this invention.
Figure 5:
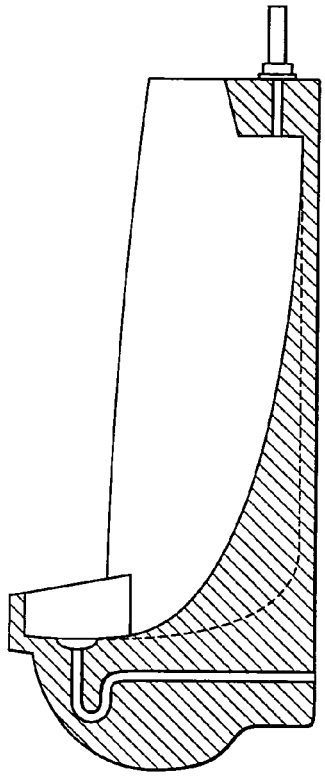
FIG. 5 is a sectional view thereof taken along line 5-5 of FIG. 4.
Figure 6:
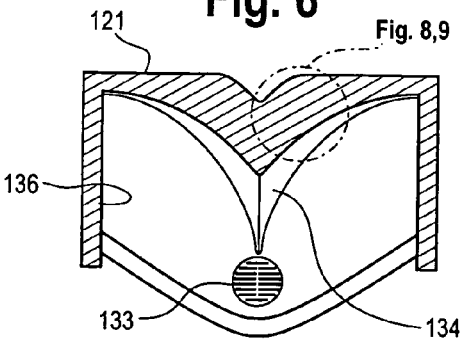
FIG. 6 is a sectional view thereof taken along line 6-6 of FIG. 4.

This invention is best understood by references to the drawings. Referring first to FIGS. 1 to 3, a first embodiment 10 of the urinal of this invention comprises an outer body 20 having an inner cavity 30 for receiving a stream of urine.

The outer body 20 of the urinal is conventional. It is sized and shaped to receive a stream of urine from one man. It contains a back wall 21 that is adapted for mounting onto or against the wall of a washroom. A top surface 22 projects outwardly from the top of the rear wall. A water inlet 23 is mounted in the top surface to accommodate a flushing means such as a water line with a manual or automatic flushing valve. A bottom surface 24 projects outwardly from the bottom of the back wall. The bottom surface is bowl shaped and projects outwardly further than the top surface. Side walls 25 project outwardly and extend between the top surface and the bottom surface. The outer body of the preferred embodiment is elevated off the floor. If desired, the outer body can extend to the floor, but this shape is less desirable because it is larger and more expensive to manufacture.

The inner cavity 30 of the urinal contains an upper surface 31 (hidden from view under the top surface of the outer body) and a lower surface 32 having a drain 33. The rear surface of the inner cavity has projecting rear walls 34. The projecting rear walls converge to form sides of an outwardly-projecting vertical ridge 35. The term "projecting" as used herein is relative, i.e., the rear walls project as they get closer to the vertical ridge and recede as they get further away. The term "vertical" is used herein to mean that the ridge runs from the upper part of the rear wall to the lower part of the rear wall. The ridge is preferably exactly vertical, but diagonal or angled ridges are also suitable. The projecting rear walls are preferably concave, i.e., curved inwardly as best seen in FIG. 3, for optimal splash elimination.

The vertical ridge runs all or substantially all the height of the rear surface. The vertical ridge preferably extends downward along the lower surface to the back edge of the drain. Although not shown in FIGS. 1 to 3, the ridge can resume at the front edge of the drain and extend to the front wall. The vertical ridge preferably projects outwardly from top to bottom, as best seen in FIGS. 2 and 3. In other words, the bottom of the vertical ridge is closer to the user than the top. The vertical ridge of the preferred embodiment is centrally located so that it is directly in front of a user. Although a sharp edge on the vertical ridge is optimal for eliminating splash when a stream of urine exactly hits the edge, the edge of the vertical ridge is preferably slightly rounded. A rounded edge is nearly as effective at eliminating or reducing splash while providing additional strength and eliminating the possibility of cuts to an installer or user.

The vertical ridge and the rear walls are fully exposed in an outward direction. In other words, there are no shields, deflectors, or other obstructions between them and a user standing in front of the urinal. Shields, deflectors, and other obstructions are unnecessary for splash elimination and are undesirable for many reasons, including manufacturing concerns, durability, aesthetics, etc.

In the first embodiment, the two side walls 36 of the inner cavity are also concave. They recede as they transition from the sides to the rear walls. As best seen in FIG. 3, the cross-section of the inner cavity has the approximate shape of the heart symbol (e.g., the symbol used for the hearts suit in playing cards) with the vertical ridge forming the separation of the two lobes. The exact configurations of the rear walls and vertical ridge are matters of choice depending upon space availability within the cavity, manufacturing concerns, durability, aesthetics, etc.

Figure 8:
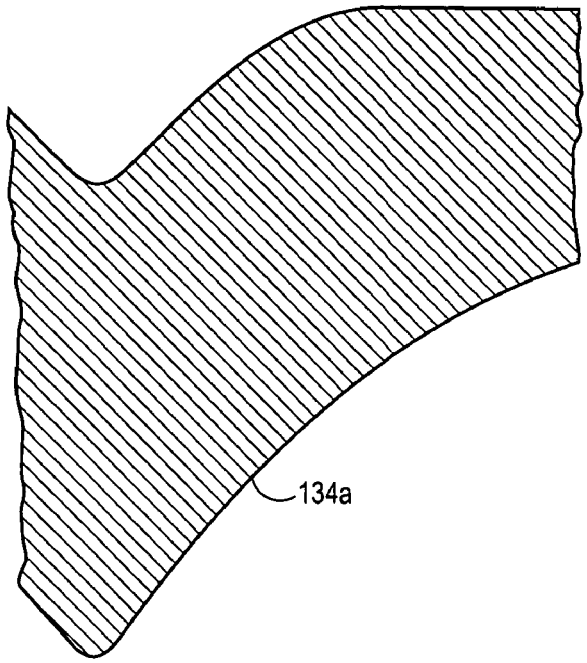
FIG. 8 is a detail of FIG. 6.
Figure 9:
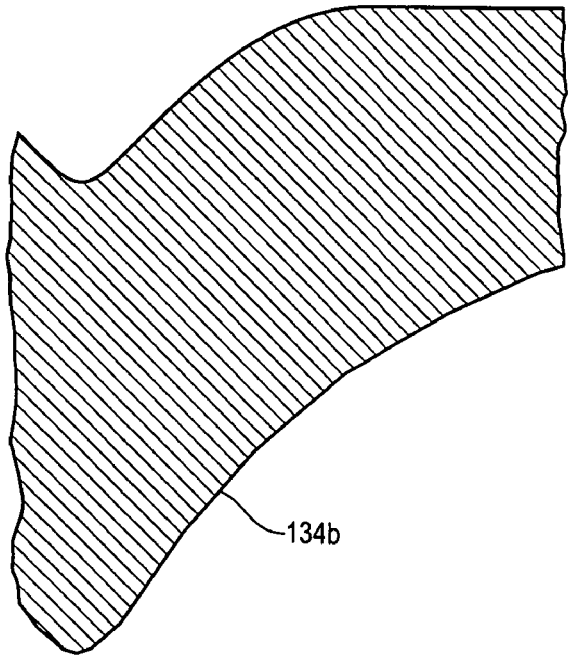
FIG. 9 is an alternate detail of the portion shown in FIG. 6.
Figure 10:
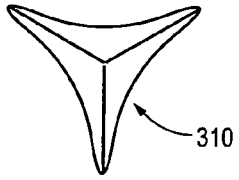
FIG. 10 is a top plan view of a first embodiment of a retrofit insert that converts a conventional urinal to the urinal of this invention.
Figure 11:
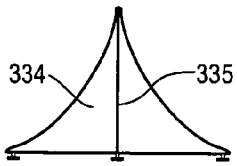
FIG. 11 is a front elevation view thereof.
Figure 12:
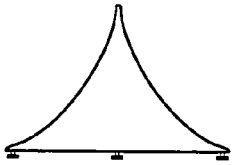
FIG. 12 is a rear elevation view thereof.
Figure 13:
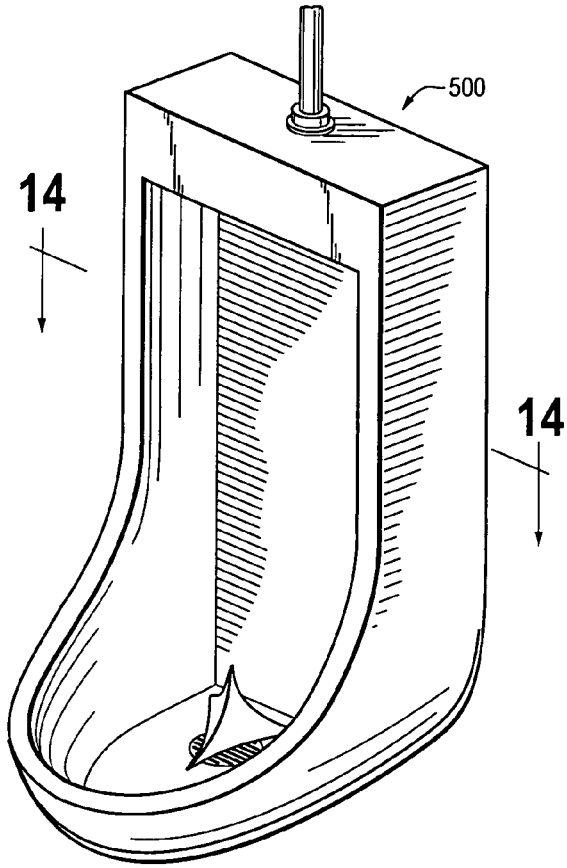
FIG. 13 is a perspective view of the retrofit insert in place in a conventional urinal.
Figure 14:
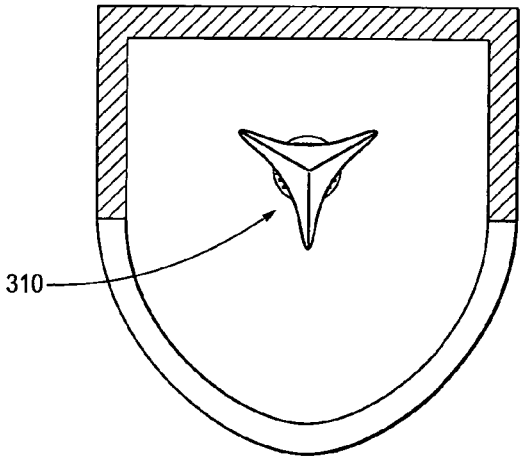
FIG. 14 is a sectional view thereof.

A second embodiment 110 of the urinal is shown in FIGS. 4 to 6 and 8 to 9. The second embodiment differs from the first embodiment in that the side walls 136 are flat, rather than concave, and in that the drain 133 is located at the front, rather than the middle, of the lower surface. FIG. 8 shows the perfectly smooth, concave surface 134*a* of the projecting rear walls. FIG. 9 shows an alternate surface 134*b* in which the concave rear walls are multi-faceted rather than perfectly smooth.

Figure 7:
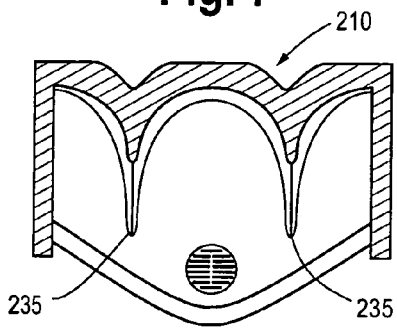
FIG. 7 is a sectional view of a third embodiment of the urinal of this invention taken along a line similar to that of FIG. 6.

A third embodiment 210 of the urinal is shown in FIG. 7. In this embodiment, the rear surface contains two outwardly-projecting vertical ridges 235 rather than one. Although not shown, another embodiment of the urinal is a trough containing multiple vertical ridges to accommodate multiple users.

Existing urinals are easily converted to the splash eliminating urinals of this invention by the addition of a retrofit insert. A conventional urinal 500 and a first insert 310 are shown in FIGS. 10 to 14. This insert is relatively small, fits over the drain, and is especially suited to replace a conventional urinal cake encased within a plastic mesh guard. The insert contains two projecting concave walls 334 and a vertical ridge 335. Splash is eliminated when a stream of urine is directed against the concave walls of the insert.

Figure 15:
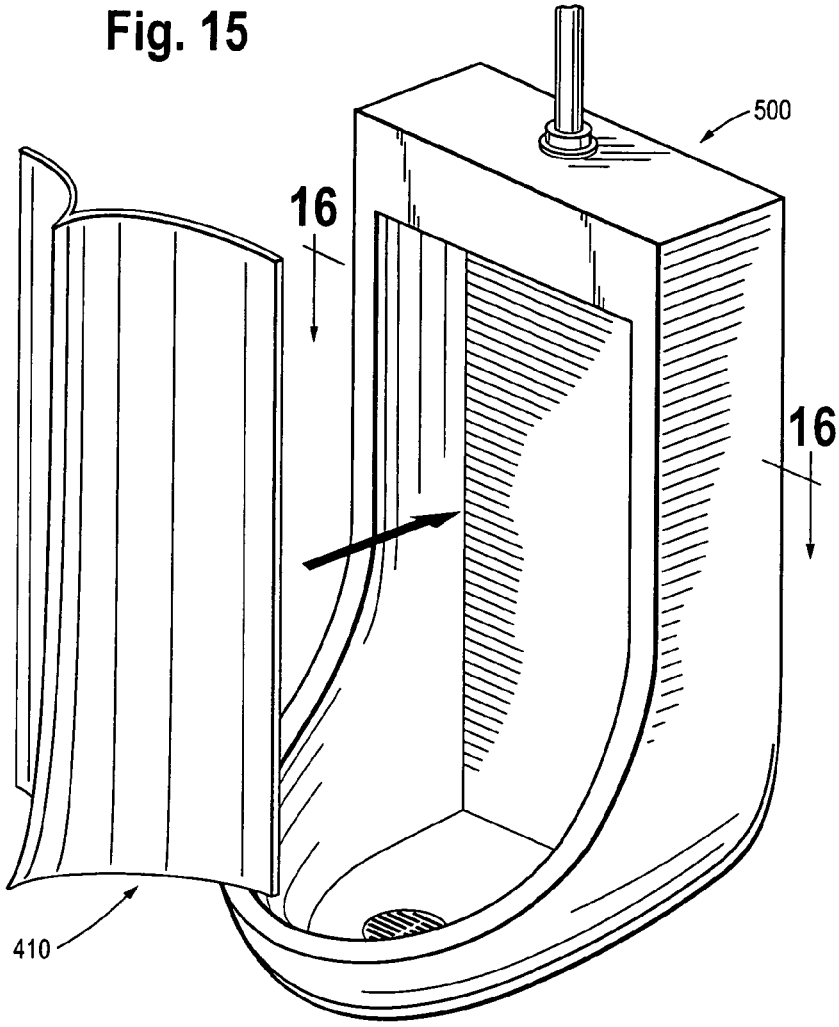
FIG. 15 is a perspective view of a second embodiment of a retrofit insert that converts a conventional urinal to the urinal of this invention.
Figure 16:
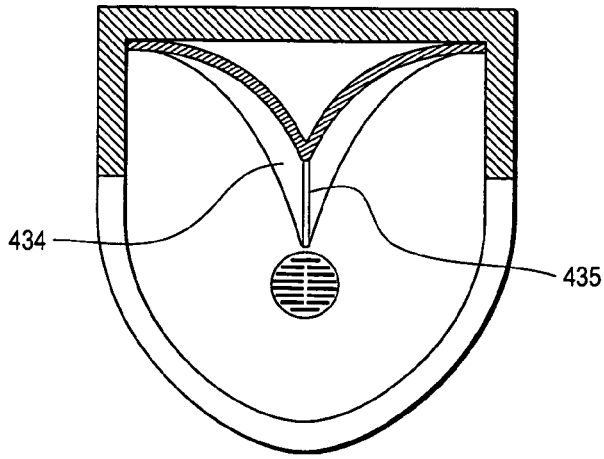
FIG. 16 is a sectional view thereof.

A conventional urinal 500 and a second retrofit insert 410 are shown in FIGS. 15 to 16. This insert is larger than the first and is adapted for placement on the back wall of a conventional urinal. The insert may rest in place or may be attached by the use of adhesive, suction cups, or the like. After placement of the insert, the urinal contains projecting concave rear walls 434 that converge to form sides of an outwardly-projecting vertical ridge 435.

The first three embodiments of the urinal of this invention are conventional in overall size and in materials of construction. A wall-mounted individual urinal is typically about two to three feet in height, about one to one and one-half feet in width, and about one foot in depth. Trough-type urinals vary widely in size depending on the number of intended users. A urinal is typically made of a rustproof metal, such as galvanized steel, or a ceramic material. The urinal is preferably manufactured to accept conventional flushing and drainage fittings. The first three embodiments of the urinal are preferably an integral unit. As discussed above, retrofit inserts containing the vertical ridge and receding rear walls can be installed on conventional urinals if desired. Any existing model of urinal can thus be easily modified to the urinal of this invention.

The use of the urinal can now be considered. When a user directs his stream of urine to a projecting rear wall at or on either side of the vertical ridge, surface tension causes the urine to form an elastic sheet rather than to splash. As a result, urine is not splashed onto an adjacent surface or onto the user.

The principle of splash elimination by the use of concave receding surfaces is also useful in other plumbing fixtures that receive a liquid stream, such as sinks, drinking fountains, toilets, or the like. Each such splash-eliminating fixture comprises an outer body and a receptor cavity having a liquid-receiving surface having projecting concave walls that converge to form sides of an outwardly-projecting ridge.

I claim:

1. A urinal comprising:

(a) an outer body comprising a rear wall having a top and a bottom, a top surface projecting outwardly from the top of the rear wall, a bottom surface projecting outwardly from the bottom of the rear wall, and two side walls projecting outwardly and extending between the top surface and the bottom surface; and (b) a receptor cavity within the outer body, the cavity comprising an upper surface, a lower surface having a drain, a rear surface having at least one pair of projecting rear walls that have a width, that are concave for at least substantially all their width, and that converge to form sides of an outwardly-projecting vertical ridge, and two side walls that transition to the rear walls, the vertical ridge and rear walls being fully exposed outwardly without any shielding means;

such that a stream of urine directed onto the rear walls adheres by surface tension without causing a splash.

2. The urinal of claim 1 wherein the side walls are concave.

3. The urinal of claim 2 wherein the distance between the upper surface and lower surface of the cavity defines a height of the rear surface and wherein the vertical ridge runs at least substantially all the height of the rear surface.

4. The urinal of claim 3 wherein the vertical ridge projects outwardly from the upper surface to the lower surface of the receptor cavity.

5. A liquid-stream-receiving plumbing fixture comprising an outer body and a receptor cavity, the receptor cavity comprising a drain and a liquid-stream-receiving surface having at least one pair of projecting walls that have a width, that are concave for at least substantially all their width, and that converge to form sides of an outwardly-projecting ridge, the ridge and the walls being fully exposed outwardly without any shielding means.

6. The plumbing fixture of claim 5 wherein the projecting concave walls form rear walls of the receptor cavity.

7. A urinal comprising a receptor cavity having a rear surface with at least one pair of projecting rear walls that have a width, that are concave for at least substantially all their width, and that converge to form sides of an outwardly-projecting vertical ridge, the rear walls and vertical ridge being fully exposed outwardly without any shielding means.

8. The urinal of claim 7 wherein the vertical ridge projects outwardly from top to bottom.

9. The urinal of claim 8 wherein the rear walls and vertical ridge are part of an insert.

* * * * *